US006843093B2

(12) United States Patent
Lindner et al.

(10) Patent No.: US 6,843,093 B2
(45) Date of Patent: Jan. 18, 2005

(54) METHOD FOR MANUFACTURING STRUCTURAL COMPONENTS FROM AN EXTRUDED SECTION

(75) Inventors: Karl-Heinz Lindner, Mulheim (DE); Alf Birkenstock, Heiligenhaus (DE)

(73) Assignee: Erbsloh Aktiengesellschaft, Velbert (DE)

( * ) Notice: Subject to any disclaimer, the term of this patent is extended or adjusted under 35 U.S.C. 154(b) by 0 days.

(21) Appl. No.: 10/366,712

(22) Filed: Feb. 12, 2003

(65) Prior Publication Data

US 2004/0045335 A1 Mar. 11, 2004

Related U.S. Application Data

(63) Continuation of application No. PCT/EP03/00893, filed on Jan. 29, 2003.

(30) Foreign Application Priority Data

Sep. 5, 2002 (DE) ..... 102 41 028

(51) Int. Cl.[7] ..... B21C 23/00

(52) U.S. Cl. ..... 72/254; 72/38; 72/256; 72/257; 29/897.2

(58) Field of Search ..... 72/17.3, 38, 254, 72/256, 257, 261; 148/666, 667, 689, 690, 691, 692, 695, 696, 697, 698, 702; 29/89.7, 897.2

(56) References Cited

U.S. PATENT DOCUMENTS

| | | | | | |
|---|---|---|---|---|---|
| 4,653,364 | A | * | 3/1987 | Savioli | 83/37 |
| 4,939,828 | A | * | 7/1990 | Maier | 29/897.2 |
| 5,031,437 | A | * | 7/1991 | Elhaus et al. | 72/257 |
| 5,240,519 | A | * | 8/1993 | Kamio et al. | 148/415 |
| 5,305,626 | A | * | 4/1994 | Tiekink | 72/257 |
| 5,560,789 | A | * | 10/1996 | Sainfort et al. | 148/549 |
| 5,894,751 | A | * | 4/1999 | Bourgoine et al. | 72/38 |
| 5,907,968 | A | * | 6/1999 | Muschalik et al. | 72/257 |
| 5,964,967 | A | * | 10/1999 | Bryant et al. | 148/514 |
| 6,531,089 | B1 | * | 3/2003 | Brungs et al. | 419/28 |

FOREIGN PATENT DOCUMENTS

| | | |
|---|---|---|
| EP | 0 706 803 | 4/1996 |

* cited by examiner

*Primary Examiner*—Ed Tolan
(74) *Attorney, Agent, or Firm*—Katten Muchin Zavis Rosenman

(57) ABSTRACT

In a method for manufacturing structural components from an extruded section, especially consisting of Al, Mg or their alloys, which after its exit from the die of the extrusion press, is guided by one or a plurality of guide tools for the purpose of forming it as a straight or arc-shaped (rounded) section, an end section is separated by a separating tool and in the hot state, is fed by means of gripping tools to a hot-forming process and successively to one or a plurality of processing stations.

17 Claims, 2 Drawing Sheets

METHOD FOR MANUFACTURING STRUCTURAL COMPONENTS FROM AN EXTRUDED SECTION

This application is a continuation of PCT/EP03/00893 filed on Jan. 29, 2003.

The invention relates to a method for manufacturing structural components from an extruded section, especially consisting of aluminium (Al), magnesium (Mg) or their alloys, which after its exit from the die of the extrusion press, is guided by one or a plurality of guide tools for the purpose of forming it into a straight or arc-shaped (rounded) section after which an end section is separated by a separating tool and successively fed to one or a plurality of processing stations.

Such a method is known in the specialist world, e.g. in the area of car manufacture. The space-frame concept known in car manufacture uses such aluminium extruded sections both as straight sections and also in the form of rounded sections. A method of manufacture herefor is described, for example, in European Patent EP 0706843 B1.

With the increasing importance of light-weight construction in the building of motor vehicles, as well as aluminium sections, those made of magnesium or from alloys of the two materials, e.g. AlMgSi, AlZnMg, MgAl3Zn1 (AZ31) or MgMn2 (AM 503) are also being increasingly used. In the manufacture of structural components made of said materials, not inconsiderable problems arise which are especially related to the manufacturing-induced cross-sectional deformations in the case of bent extruded sections and their spring-back resilience, which is difficult to control and thus incurs additional costs during further processing. e.g. if automated production is desired. During subsequent machining operations such as cutting or joining, residual stresses of such extruded sections are frequently released and these can only be controlled with difficulty and jeopardise the maintaining of the required accuracy.

Thus, a new manufacturing concept is sought in which, starting from the extrusion process, structural components having an especially high accuracy in terms of the cross-sectional dimensions of the section and, if appropriate, its curvature, can be manufactured with a simultaneous reduction in costs or an acceptably low increase in costs.

In order to satisfy the technical requirements it has already been proposed that the contour and the cross-section should be calibrated by internal high-pressure forming (IHF) of the extruded section. A disadvantage here however are the extremely high tool costs.

On the other hand, it is difficult or even impossible, but at least associated with unjustifiably high expenditure, to manufacture extruded sections with the accuracy required for the end product directly, i.e., as the immediate result of the extrusion process.

Also according to the known method of directly rounding the extruded section at the exit from the die by applying a controlled transverse force to bend the section, achieving the required trueness to contour, especially with three-dimensional sections of variable curvature, presents barely surmountable technical difficulties.

In contrast to this, an important proposal according to the present invention is that after separating a section of the extruded section by means of a separating tool, the extruded section is supplied in the hot state to a hot forming process by means of gripping tools. As a result of this step, the heat of the hot strand is retained for the following hot forming process whereby components ready for fitting can be manufactured as a result of this hot-forming process. In this case, the suitable working window for the material relating to the forming temperature giving the optimum forming capacity for aluminium or magnesium or for aluminium/magnesium alloys can be attained without additional expenditure of energy or without major expenditure of energy, i.e., by cooling the tool.

In the interests of manufacturing saleable products, instead of an expensive forming process, preferably economically favourable hot-forming processes such as forging or embossing can be considered, for example, in the development of the internal high-pressure forming.

A particular advantage of the method according to the invention is that it offers the possibility of accepting lower accuracy requirements with regard to the contour of the extruded section, since the hot-forming step can be used at the same time for calibration in order to achieve the precise shape of the finished structural component.

An additional advantage of the method according to the invention is that through its inclusion of the hot forming process step, it is possible to increase the net product because further shaping features of the end product such as the incorporation of holes, the formation of small inserts or the like can be accomplished in the same process step.

As a result of the lower accuracy requirements for the extruded section, the extrusion speed can be increased whereby the extrusion plant whose purchase involves high costs can be utilised more efficiently.

During the manufacture of structural components made of magnesium or magnesium alloys, in order to maintain the structure it is advisable if the production chain is entirely or partly enveloped in protective gas, namely from the extrusion press as far as the hot-forming process. In this connection it has already been proposed that the casting process preceding the extrusion press should also be carried out in an inert atmosphere.

According to a further proposal of the invention, it is provided that Al and Mg semi-finished-parts should be joined one to another by means of friction stir welding to form new structural components. This can be suitably carried out in a welding and processing centre arranged after the artificial ageing following the hot forming process. Alternatively, the Al and Mg components can be joined by adhesion. In this case, it should be ensured that that the adhesive components are applied after the hot forming so that the ultimate strength is achieved in the following artificial ageing.

A possible development of the forming process involves the extruded sections being further processed in an IHF step (internal high-pressure forming). However, the high tool costs associated therewith are frequently cited as reasons for not using the IHF method which is inherently desirable because of its accuracy. For calibrating Al components IHF is always configured as cold forming as is the usual procedure; for Mg components however, this is advantageously a hot-forming process. In this way the formation of an unfavourable hexagonal metal lattice structure is avoided for the first time.

Forging should be taken into consideration as a substantially more favourable method; it is also possible to have an embossing step implemented as hot forming which has a higher accuracy compared with forging. A sequential sequence of both methods can also be advantageous if necessary.

In order to obtain structural components manufactured in a hot forming process, for example, by forging with a desired high forming accuracy, it is advantageous according to the invention that the hot-forming process comprises a calibration step which, for example, follows the forging.

A factor common to all procedural steps is that they require precise temperature control for their optimisation. Starting from the heat of the hot strand from the extrusion press, this involves utilising this heat for the subsequent hot-forming process, i.e., ensuring that temperature range for the hot forming in which an optimum forming result can be expected, which is matched to the processed material.

In this sense, according to a further proposal according to the invention it is provided that in the hot-forming process the hot-forming temperature or, before other processing stations, the processing temperature should be adjusted to the optimum temperature for the particular alloy of the workpiece to be manufactured by cooling the workpiece.

For the manufacture of Mg structural components this advantageously means setting a hot-forming temperature of 180° C. to 400° C., preferably 225° C. to 280° C.

In the case of a so-called age-hardening aluminium wrought alloy (Al—Mg—Si alloys) a suitable temperature for the hot forming after the extrusion press is below 200° C. In this case, the cooling of the extruded section is more suitably carried out abruptly so that no Mg2Si precipitations occur in a temperature range of 520° C. to 200° C. The following hot-forming step should then be carried out in the shortest possible time in order to fully utilise the complete forming capability of this material before hardening of the material takes place as a result of Mg2Si precipitations.

For the manufacture of Al structural components it is advantageous according to the invention if the hot-forming temperature is set between 300° C. and 600° C., preferably between 400° C. and 520° C.; if an embossing step is provided, it is advantageous if the forming temperature is set rather near the upper limit of said temperature range, i.e. near 600° C.

As part of the invention, during the processing of Al and Mg structural components the hot-forming process may be followed by further processing stations, preferably artificial ageing in the heating furnace and then various mechanical processing stations, wherein the workpiece can be cooled in a preceding cooling zone before the artificial ageing. However, the cooling zone can also be provided before the hot-forming process. This particularly applies to the processing of age-hardening Al wrought alloys. As has already been noted, here it is a case of avoiding any undesired structural hardening caused by Mg2Si precipitation.

In order to achieve an optimised linkage of the entire production process, extensive automation is advantageous because of the high process temperatures. In particular, the intermediate storage of semi-finished products can thereby be avoided.

This aim is served by further developments of the invention whereby the workpiece is transferred between the work stations by gripping tools in the fashion of handling robots and further by the guiding and separating tools also being constructed in the fashion of robots, namely as guiding and separating robots. Whereas the guiding robots are supported fixed in space outside the strand to take up deformations forces, the separating robots allow themselves to be moved with the strand, being fixed on the emerging strand in the region of the separating point, at least as long as the separating device of the separating robot is operating.

The guiding robots have a guide device which is moveable in a plane perpendicular to the pressing plane and/or rotatable about its longitudinal axis. This is used to deform the extruded section within a plane having constant or variable radius and to twist the section about its longitudinal axis.

Furthermore, it is advantageous if the cycle times with which the process and processing steps follow one another are substantially matched to the particular extrusion speed. Accordingly it is provided according to the invention that for the manufacture of Al structural components a multiplication is installed after the extrusion press, i.e. a doubling of the production chain required for Mg structural components. This is obtained as a consequence of the significantly higher extrusion speeds for aluminium components (up to 25 m/min) compared with magnesium components (up to 1.5 m/min).

For the manufacture of structural components from rounded extruded sections, which occur especially frequently in automobile body construction, it is provided according to the invention that at least one guiding robot is path-controlled depending on the pressing distance of the extruded section and on the particular curvature profile, wherein the pressing distance can be measured directly on the emerging strand by means of a sensor device attached to the guiding robot.

In this case, the extruded section is deformed by the guiding robot and suitably supported by a handling robot before being finally cut to length by a separating robot. If the geometry of the component is simple, a delivery table may be sufficient for support.

In the minimum equipment for the production method according to the invention, in addition to the separating robot and a handling robot which takes the separated component and supplies it to the hot-forming process, if appropriate, it may be necessary to have just one guiding robot which takes over the rounding of the extruded section emerging rectilinearly from the extrusion press and at the same time supports this. Under certain geometric conditions, both straight and arbitrarily curved components can thus be manufactured. For especially complex components, which for example are rounded with variable radii and also deformed by twisting, at least two guiding robots are appropriate.

Robotics requires an especially high expenditure for the manufacture of three-dimensionally rounded extruded sections with variable curvature. In order to achieve such contours, at least two space axes and the angle of twist must be controlled numerically in addition to a distance sensor. In this case, the three-dimensional curved extruded section can no longer be placed on a delivery table but must be supported in space by two or more handling robots such that any undesired deformation of the still soft extruded section is avoided.

Two embodiments for the production chain according to the invention are described in the following.

Figure 1:
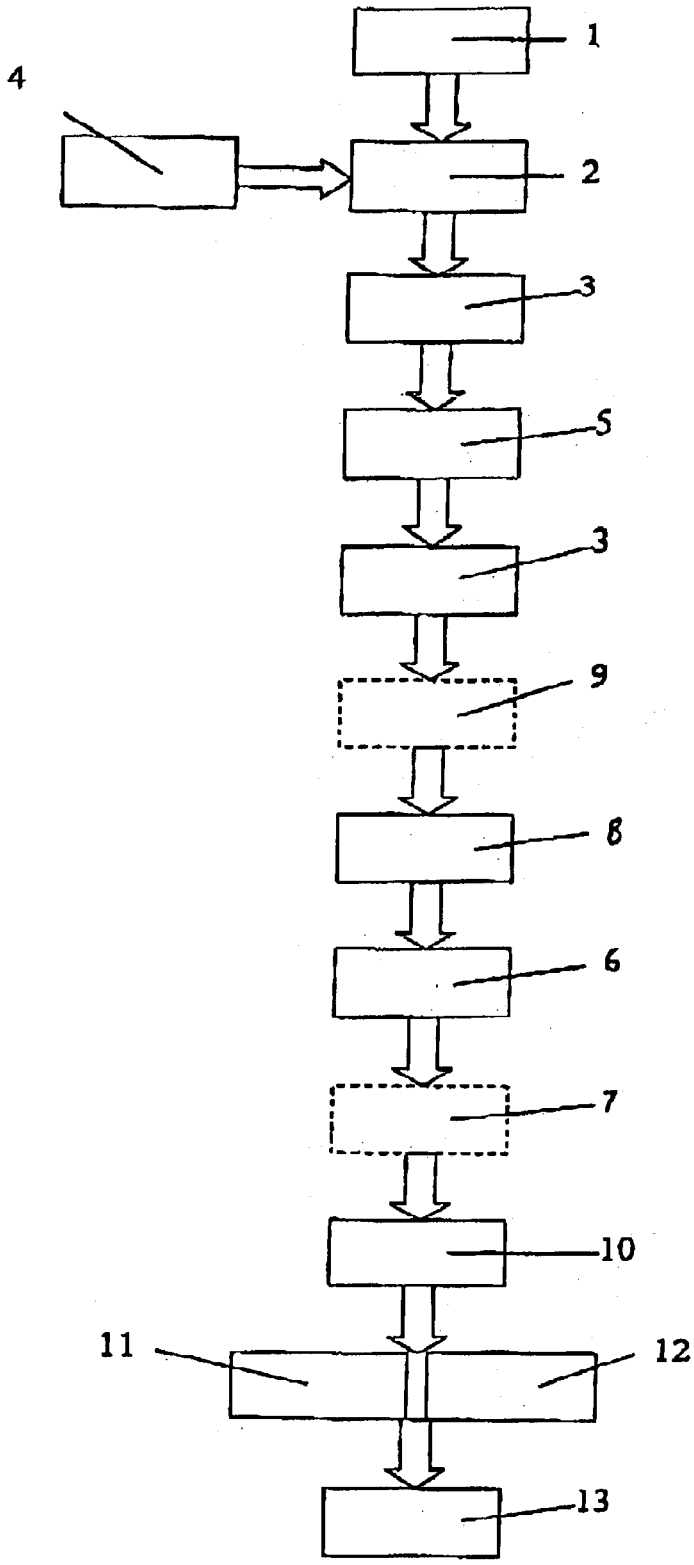
FIG. 1 shows a block diagram for a production chain for an Al structural component.
Figure 2:
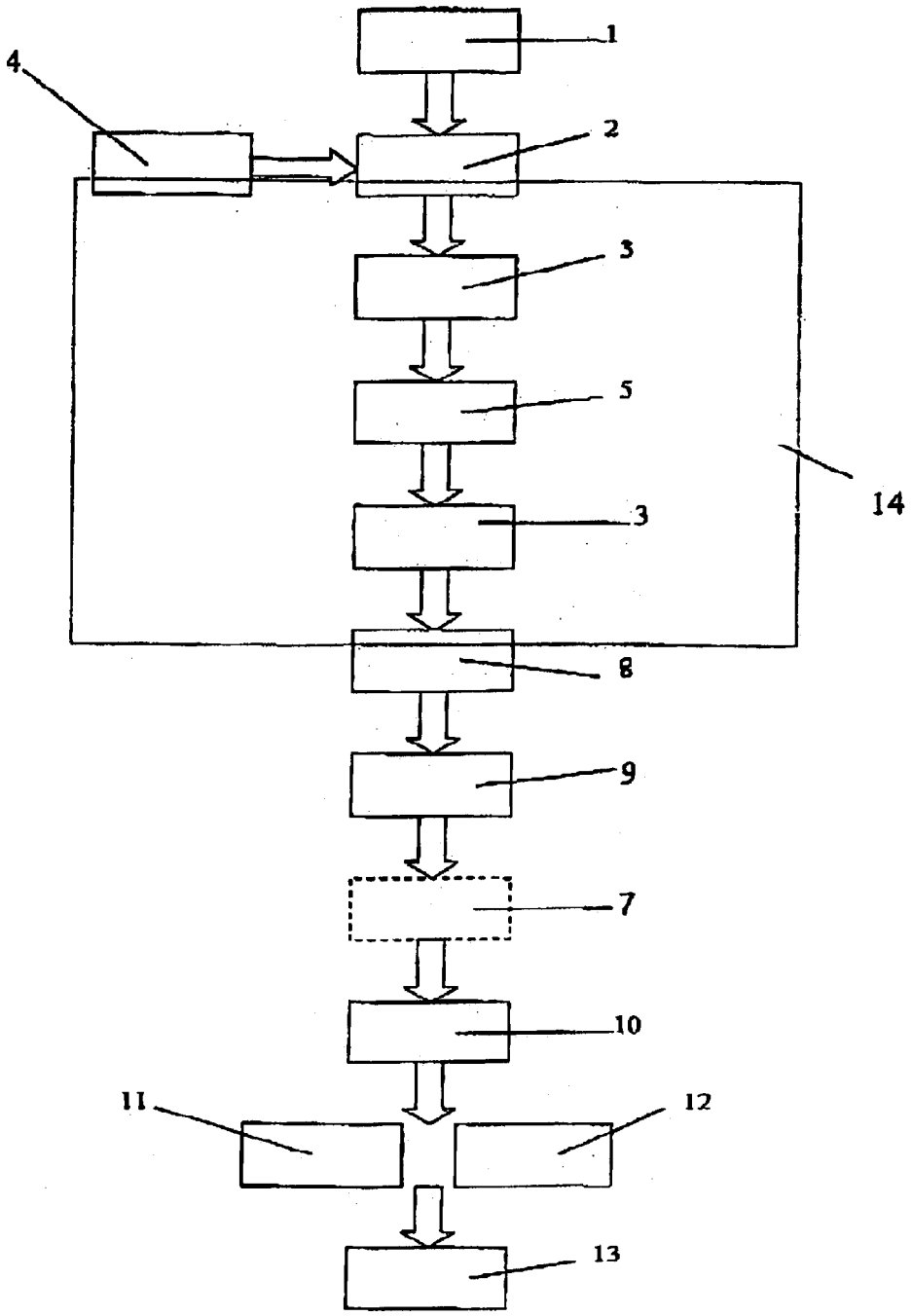
FIG. 2 shows a block diagram for a production chain for an Mg structural component.

Where the two production chains in FIGS. 1 and 2 agree, the same reference symbols are used.

According to FIG. 1, an extrusion press 1 is followed by one or several guiding robots 2 which are controlled by means of a path control system 4. The guiding robots 2 have guiding devices e.g. in the form of roller cages which guide or support the extruded section extruded from the extrusion press 1 and, in the case of a rounded section, deform with constant or variable curvature in a single plane or in space. For this purpose it is necessary to exactly measure the path of the extruded section leaving the press, which is advantageously accomplished using a non-contact path sensor of a path control system 4, and to measure the curvature which is advantageously accomplished by three non-contact optical sensors which are arranged displaceably on rails transverse to the section.

Depending on the complexity of the contour of the extruded section and depending on its inherent stability in the hot state, it may be necessary to have up to three handling robots 3, which grasp the section without exerting any deformation forces, support it and finally transfer it to a following separating robot 5 which is provided with a separating tool, for example in the form of a circular saw, which separates the extruded section during a short interruption of the extrusion process. Alternatively it is possible to have a flying saw which separates the extruded section without interrupting the extrusion process, by being moved with the extruded section together with the separating robot to which it is attached.

In the case of a three-dimensional contour of the rounded extruded section, it is necessary to have a plurality of following handling robots 3 which are controlled such that on reaching an end position, they can be returned to a start position so that preferably two handling robots 3 always grip the extruded section while a third handling robot 3 is changed. In the case of three-dimensional rounded or curved components, instead of a guiding robot 3 with a roller cage through which the emerging strand moves, it can be advantageous to use at least two guiding robots provided with a gripping system which is capable of holding the extruded section fixed in order to transfer moments onto this, so that the respectively desired three-dimensional contour of the extruded section, consisting of curvatures and twisting, is attainable. In this case, the guiding robots 2 each take over the task of a handling robot 3.

The separated extruded section is taken over by a handling robot 3 which either feeds it directly to the hot-forming process 8 or to a cooling zone 9 preceding this (FIG. 1). After passing through the hot-forming process 8, e.g. in a drop-forge die, the formed structural component is then subjected to the artificial ageing process step 10 via handling robots 3 or another transport device before it is fed to a following process centre by means of further handling robots 3.

If the Al structural component according to FIG. 1 is to be joined to other Mg modules, this is accomplished either by adhesion 7 before the artificial ageing 10 or in a welding and processing centre 11 for friction stir welding of Al—Mg modules. Further machining treatment can take place in a conventional processing centre 12. Only then can the finished structural component be given to dispatch 13.

The cooling zone 9 shown by the dashed line in FIG. 1 is only required for special materials for which abrupt cooling before the hot-forming process 8 is essential, as applies for example to age-hardening aluminium wrought alloys (Al—Mg—Si alloys). For these alloys it is important to avoid any hardening by Mg2Si precipitations in a temperature range of 520° C. to 200° C.

FIG. 2 relates to the manufacture of structural components made of Mg or Mg alloys. An inert-gas atmosphere shown there by a dashed box 14 is required to ensure that the structure of the processed material remains unchanged. The inert gas atmosphere envelops all the production steps from the exit from the extrusion press 1 as far as the entrance to the hot-forming process 8.

The hot-forming process 8 can be followed by a cooling zone 9 which serves to accelerate the process sequence i.e., allows the extruded section to be fed more rapidly to the following hardening in the heating furnace 10. Such a cooling zone 9 is naturally also feasible in connection with the process according to FIG. 1. If necessary, the component can be joined to further components or modules by adhesion 7 before the artificial ageing 10.

What is claimed is:

1. A method for manufacturing structural components from an extruded section consisting of Al, Mg or their alloys, comprising the steps of:

after an exit of the extruded section from a die of an extrusion press, guiding said extruded section by one or a plurality of guide tools for the purpose of forming said extruded section into a straight or arc-shaped section, separating an end section of said extruded section by a separating tool in a hot state and feeding said end section by means of gripping tools to a hot-forming process and successively to one or a plurality of processing stations, wherein before feeding to the hot-forming process or processing stations, the processing temperature is adjusted to the optimum process temperature by cooling the workpiece, wherein the temperature for the hot-forming process is between 180° C. and 400° C. for the manufacture of Mg structural components, and wherein the temperature for the hot-forming process is between 300° C. and 600° C. for the manufacture of Al structural components.

2. The method according to claim 1 wherein the manufacturing process is completely or partly enveloped by protective gas.

3. The method according to claim 1, further comprising the steps of extruding an Aluminum workpiece and extruding a Magnesium workpiece and bringing said workpieces together by means of friction stir welding or adhesion.

4. The method according to claim 1, wherein the hot-forming process is configured as internal high-pressure forming, forging or embossing.

5. The method according to claim 1, wherein the hot-forming process comprises a calibration step.

6. The method according to claim 1, wherein for the manufacture of Mg structural components the hot-forming temperature is between 225° C. to 280° C.

7. The method according to claim 1, wherein for the manufacture of Al structural components the hot-forming temperature is between 400° C. to 520° C.

8. The method according to claim 1, wherein the hot-forming process is followed by artificial aging and then by mechanical processing, wherein the workpiece is cooled in a preceding cooling zone before the artificial aging.

9. The method according to claim 1, wherein the workpiece is transferred between the processing stations by gripping tools in the fashion of handling robots which follow the extruded section.

10. The method according to claim 1, wherein the guiding and separating tools are each constructed as guiding and separating robots.

11. The method according to claim 10, wherein the guiding robots are each supported in a spatially fixed position outside the extruded section and are provided with a guiding device which is moveable in a plane perpendicular to the pressing plane and/or is rotatable its axis of rotation.

12. The method according to claim 10, wherein the separating robots are each connected firmly to the extruded section in the range of a separating point during the separating step.

13. The method according to claim 1, wherein at least one guide tool is path-controlled depending on a pressing path and on a curvature trend of the extruded section.

14. The method according to claim 13, wherein a pressing distance is measured directly on the workpiece by means of a sensor device attached to the guide tool.

15. The method according to claim 14, wherein the extruded section is guided by several reversibly controlled guiding tools.

16. The method according to claim 1, wherein the cycle times with which the process and processing steps follow one another are substantially matched to the extrusion speed.

17. The method according to claim 15, wherein the extruded section is deformed by at least one guiding tool wherein at least two handling tools can be alternately returned to the beginning and support the emerging extruded section.

* * * * *